US011102562B2

(12) United States Patent
Ye

(10) Patent No.: US 11,102,562 B2
(45) Date of Patent: Aug. 24, 2021

(54) MICROPHONE ENCAPSULATION STRUCTURE HAVING A PLURALITY OF TRANSDUCERS

(71) Applicants: ZILLTEK TECHNOLOGY (SHANGHAI) CORP., Shanghai (CN); ZILLTEK TECHNOLOGY CORP., Taiwan (CN)

(72) Inventor: Jinghua Ye, Shanghai (CN)

( * ) Notice: Subject to any disclaimer, the term of this patent is extended or adjusted under 35 U.S.C. 154(b) by 0 days.

(21) Appl. No.: 16/897,058

(22) Filed: Jun. 9, 2020

(65) Prior Publication Data

US 2021/0185419 A1 Jun. 17, 2021

(30) Foreign Application Priority Data

Dec. 17, 2019 (CN) ..... 201911304917.X

(51) Int. Cl.
*H04R 1/00* (2006.01)
*H04R 1/04* (2006.01)

(52) U.S. Cl.
CPC ..... *H04R 1/04* (2013.01)

(58) Field of Classification Search
CPC ..... H04R 1/00; H04R 2205/022; H04R 2201/401; H04R 2201/405; H04R 1/08; H04R 9/08; H04R 11/04; H04R 17/02
USPC ..... 381/182, 369
See application file for complete search history.

(56) References Cited

U.S. PATENT DOCUMENTS

2013/0070951 A1* 3/2013 Tanaka ..... H04R 1/38 381/361
2015/0003659 A1* 1/2015 Theuss ..... H04R 19/005 381/355
2015/0010191 A1* 1/2015 Baumhauer, Jr. ..... H04R 1/04 381/355
2015/0023523 A1* 1/2015 Elian ..... B81B 7/0061 381/91

* cited by examiner

*Primary Examiner* — Suhan Ni
(74) *Attorney, Agent, or Firm* — Clement Cheng

(57) ABSTRACT

The invention discloses a microphone encapsulation structure having a plurality of transducers, comprising: a housing; a circuit base plate, wherein the circuit base plate and the housing form an acoustic cavity, and a first acoustic through-hole is provided on the circuit base plate; a PCB (Printed Circuit Board) substrate disposed at a top of the circuit base plate, wherein the PCB substrate is provided with a plurality of second acoustic through-holes and the PCB substrate is provided with: a plurality of acoustic transducers each disposed directly above one of the plurality of second acoustic through-holes; and a plurality of ASIC (Application Specific Integrated Circuit) chips each connected to one of the plurality of acoustic transducers via gold wire.

9 Claims, 5 Drawing Sheets

MICROPHONE ENCAPSULATION STRUCTURE HAVING A PLURALITY OF TRANSDUCERS

CROSS-REFERENCE TO RELATED APPLICATIONS

The present application claims priority to and the benefit of Chinese Patent Application No. CN 201911304917.X, filed on Dec. 17, 2019, the entire content of which is incorporated herein by reference.

BACKGROUND OF THE INVENTION

1. Field of the Invention

The invention relates to the field of electronic devices, and more particularly, to a microphone encapsulation structure having a plurality of transducers.

2. Description of the Related Art

As shown in FIG. 1, conventional microphones have a structure comprising: a housing 1, inside which an acoustic transducer 2 is enclosed for sensing audio signals, and an ASIC (Application Specific Integrated Circuit) chip 3, wherein the acoustic transducer 2 is connected to the ASIC chip 3 via signals. The acoustic transducer 2 converts sound pressure into electrical signals, and the ASIC chip 3 is used to process the electrical signals and to transmit the processed electrical signals to a relevant signal processing device for further processing, so that audio capture is achieved. The structure of a single acoustic transducer has the disadvantages that the performance of audio capture is poor, the noise may not be effectively suppressed, and the audio performance is decreased. The improvement has now made that the microphone comprises a plurality of acoustic transducers 2 to improve the performance, however, such a structure has a problem that acoustic through-holes share a common cavity with sound inlet holes of the plurality of acoustic transducers, so microphone generates noise while making sound.

SUMMARY OF THE INVENTION

In order to solve the above-mentioned technical problems in the prior art, the present invention provides a microphone encapsulation structure having a plurality of transducers.

The technical solution is as follows:

a microphone encapsulation structure having a plurality of transducers, comprising:

a housing;

a circuit base plate, wherein the circuit base plate and the housing form an acoustic cavity, and a first acoustic through-hole is provided on the circuit base plate;

a PCB (Printed Circuit Board) substrate disposed at a top of the circuit base plate, wherein the PCB substrate is provided with a plurality of second acoustic through-holes and the PCB substrate is provided with:

a plurality of acoustic transducers each disposed directly above one of the plurality of second acoustic through-holes; and a plurality of ASIC (Application Specific Integrated Circuit) chips each connected to one of the plurality of acoustic transducers via gold wire.

Preferably, wherein a bottom surface of the circuit base plate is provided with a plurality of bonding pads electrically connected to the PCB substrate.

Preferably, wherein the first acoustic through-hole is arranged at a center of the circuit base plate.

Preferably, wherein the number of the acoustic transducer is four, the four acoustic transducers are arranged on the PCB substrate in two rows and in two columns, and a sound inlet hole of each of the four acoustic transducers corresponds to each of the plurality of second acoustic through-holes.

Preferably, wherein an opening of the first acoustic through-hole surrounds an area directly below all of the second acoustic through-holes.

Preferably, wherein the PCB substrate is a double-layer PCB, a support partition is interposed between the PCB substrate and the circuit base plate, and a rectangular hollow hole is formed in a middle of the support partition.

Preferably, wherein an opening of the hollow hole surrounds an area directly below all of the second acoustic through-holes.

Preferably, wherein both the PCB substrate of the support partition and side surfaces of the support partition are in contact with an inner side wall of the housing.

Preferably, wherein each of the plurality of ASIC chips is located at a side surface of one of the plurality of acoustic transducers.

Preferably, wherein each of the plurality of ASIC chips is electrically connected to the PCB substrate.

By adopting the above-mentioned technical solutions, the present invention has the beneficial effects that a plurality of acoustic transducers are arranged on a PCB, and each of the plurality of acoustic transducers is connected to each of the plurality of ASIC chips, respectively, such that audio can be captured by the plurality of acoustic transducers. Two types of sound holes are arranged on the PCB and the circuit base plate, respectively. Advantageously, the sound holes are sized and positioned such that the acoustic through-holes of the encapsulation structure are not sharing a common cavity, that is, sound travels to each of the plurality of acoustic transducers by the same distance, so that noise can be effectively suppressed, and audio performance is improved; the sensitivity of the plurality of acoustic transducers is the same as that of a single acoustic transducer, thereby ensuring the sound quality and sensitivity of the microphone.

BRIEF DESCRIPTION OF THE DRAWINGS

The accompanying drawings, together with the specification, illustrate exemplary embodiments of the present disclosure, and, together with the description, serve to explain the principles of the present invention.

Figure 1:
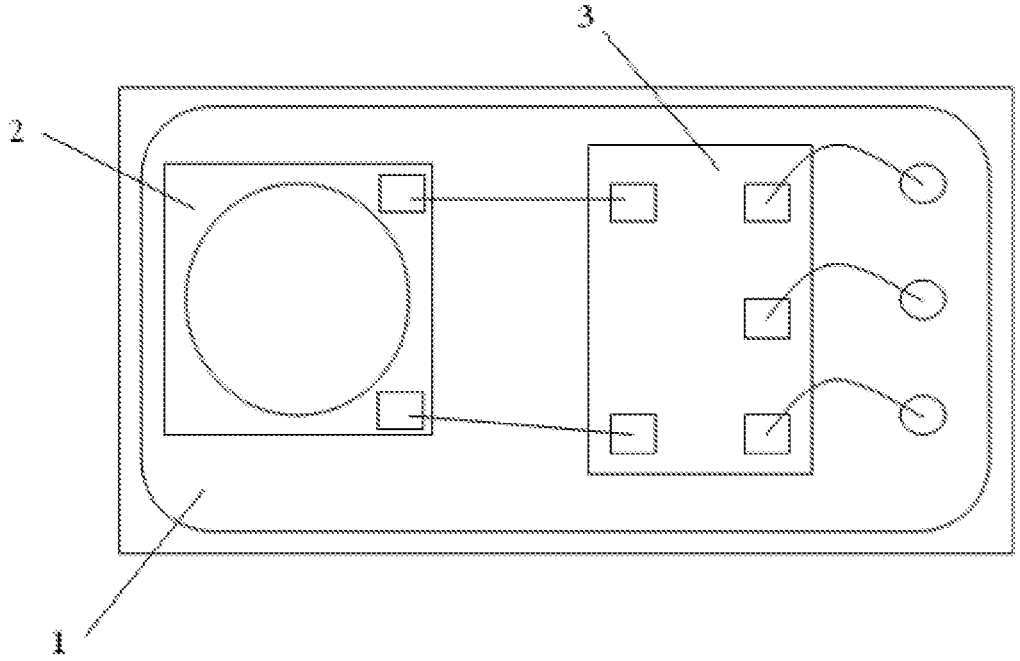
FIG. 1 is a schematic view of a conventional microphone.

In the accompanying drawings: 1. housing; 2. acoustic transducer; 3. ASIC chip; 4. circuit base plate; 5. PCB substrate; 6. second acoustic through-hole; 7. support partition; 8. hollow hole; 41. first acoustic through-hole; 42. bonding pad.

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

Figure 2:
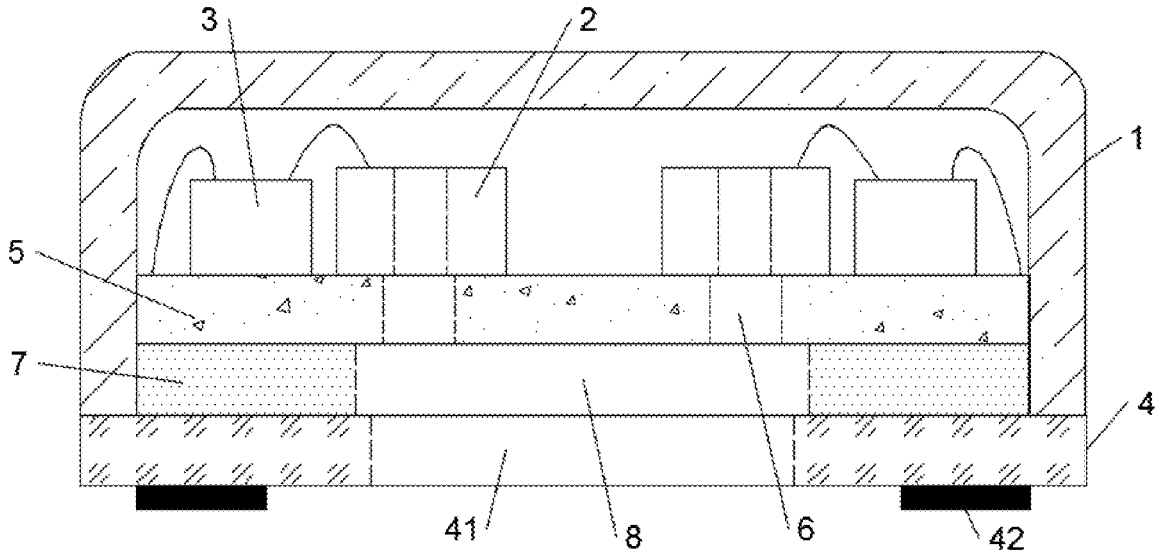
FIG. 2 is a cross-sectional view of a microphone encapsulation structure having a plurality of transducers according to the present invention.
Figure 3:
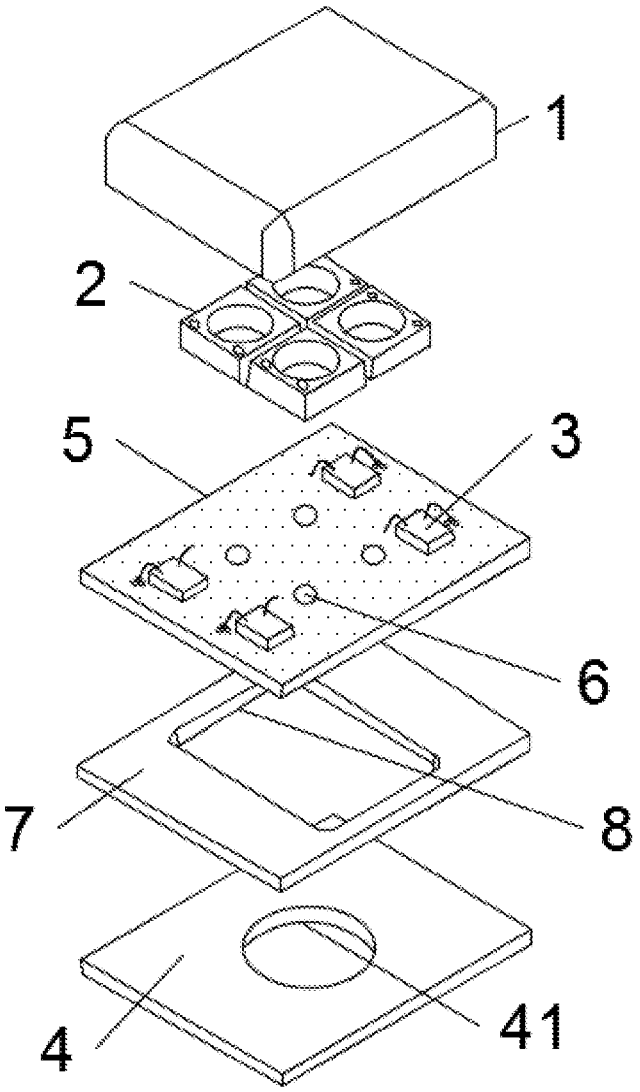
FIG. 3 is exploded view of a microphone according to the present invention.
Figure 4:
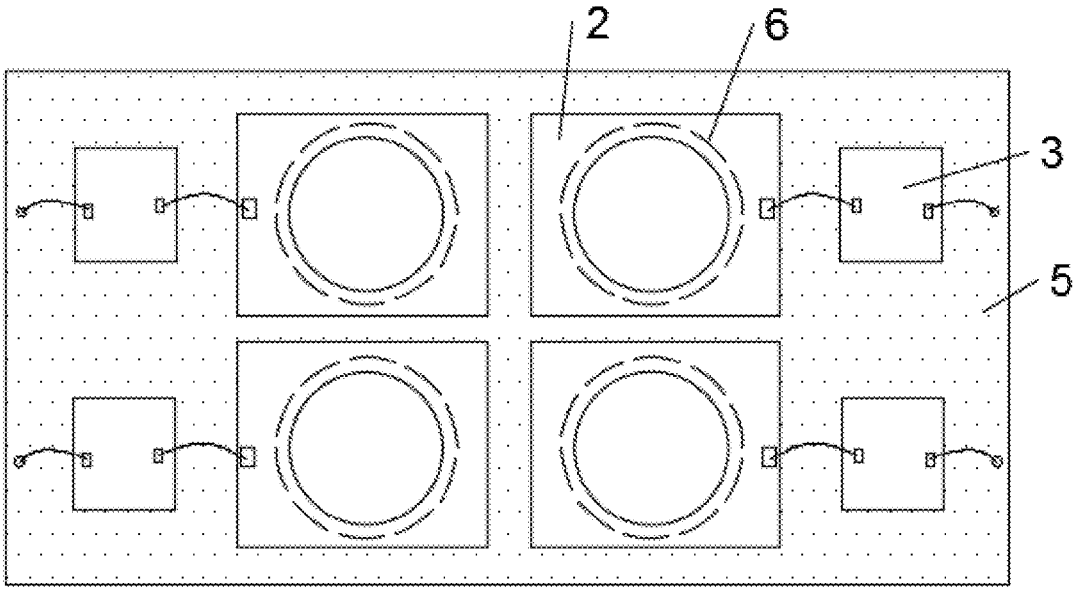
FIG. 4 is a schematic view illustrating an arrangement of acoustic transducers in a PCB substrate according to the present invention.

As shown in FIGS. 2, 3 and 4, the invention provides a microphone encapsulation structure having a plurality of transducers, comprising:

a housing 1;

a circuit base plate 4, wherein the circuit base plate 4 and the housing 1 form an acoustic cavity, and a first acoustic through-hole 41 is provided on the circuit base plate 4;

a PCB (Printed Circuit Board) substrate 5 disposed at a top of the circuit is base plate 4, wherein the PCB substrate 5 is provided with a plurality of second acoustic through-holes 6 and the PCB substrate is provided with:

a plurality of acoustic transducers 2 each disposed directly above one of the plurality of second acoustic through-holes 6; and a plurality of ASIC (Application Specific Integrated Circuit) chips 3 each connected to one of the plurality of acoustic transducers 2 via gold wire.

The present invention has the beneficial effects that a plurality of acoustic transducers are arranged on a PCB, and each of the plurality of acoustic transducers is connected to each of the plurality of ASIC chips, respectively, such that audio can be captured by the plurality of acoustic transducers. Two types of sound holes are arranged on the PCB and the circuit base plate, respectively. Advantageously, the sound holes are sized and positioned such that the acoustic through-holes of the encapsulation structure are not sharing a common cavity, that is, sound travels to each of the plurality of acoustic transducers by the same distance, so that noise can be effectively suppressed, and audio performance is improved; the sensitivity of the plurality of acoustic transducers is the same as that of a single acoustic transducer, thereby ensuring the sound quality and sensitivity of the microphone.

As a preferred embodiment of the present invention, one end surface of the circuit base plate 4 is provided with a plurality of bonding pads 42 electrically connected to the PCB substrate 5.

As a preferred embodiment of the present invention, the first acoustic through-hole 41 is arranged at a center of the circuit base plate 4 for an easy installation. It tries to ensure all the acoustic transducers have the same sound quality, so that noise from the inconsistent sound quality can be reduced.

As a preferred embodiment of the present invention, the PCB substrate 5 is a double-layer PCB, a support partition 7 is interposed between the PCB substrate 5 and the circuit base plate 4, and a rectangular hollow hole 8 is formed in a middle of the support partition 7. Since the PCB substrate 5 is the double-layer PCB, more electronic devices may be installed thereon. The electronic devices on the back of the PCB substrate 5 may be installed in the hollow hole 8. However, the electronic devices do not block any one of the second acoustic through-holes 6, and the performance of the acoustic transducers 2 can be guaranteed.

As a preferred embodiment of the present invention, the number of the acoustic transducers 2 is four, the four acoustic transducers 2 are arranged on the PCB substrate 5 in two rows and in two columns, and a sound inlet hole of each of the four acoustic transducers 2 corresponds to each of the plurality of second acoustic through-holes 6. The four acoustic transducers 2 are symmetrical about a center of the first acoustic through-hole 41, that is, the four second acoustic through-holes 6 are symmetrical about the center of the first acoustic through-hole, and sound inlet holes of the four acoustic transducers are symmetrical about the center of the first acoustic through-hole to ensure that sound in each of the acoustic transducers travels in the same path and has the same sound quality, so that noise is reduced.

Figure 5:
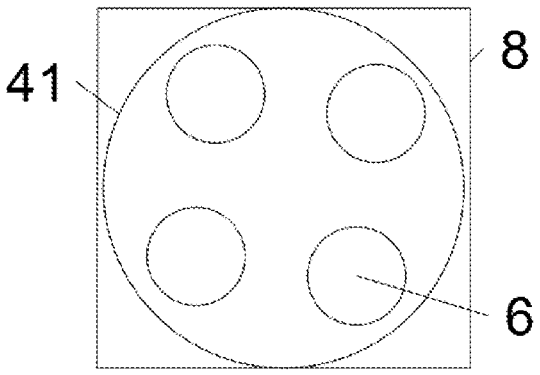
FIG. 5 is a top cross-sectional view of a first acoustic through-hole and second acoustic through-holes according to the present invention.

As shown in FIG. 5, as a preferred embodiment of the present invention, an opening of the first acoustic through-hole 41 surrounds an area directly below all of the second acoustic through-holes 6, and an opening of the hollow hole 8 surrounds an area directly below all of the second acoustic through-holes 6, that is, neither the first acoustic through-hole 41 nor the hollow hole 8 will block an audio channel of any one of the second acoustic through-holes 6. It is provided that all the acoustic through-holes do not have a common cavity, so sound travels to each of the plurality of acoustic transducers 2 by the same distance, pure sound quality may be obtained, and noise is reduced.

As a preferred embodiment of the present invention, both the PCB substrate 5 of the support partition 7 and side surfaces of the support partition 7 are in contact with an inner side wall of the housing 1. Its compact structure allows the PCB substrate 5 to be accommodated in the housing 1 without any waggle, and the service life is increased. Since the housing 1 is a metal housing, it has functions of electrostatic shielding and electromagnetic shielding, thereby making the microphone have a longer service life.

As a preferred embodiment of the present invention, each of the plurality of ASIC chips 3 is located at a side surface of one of the plurality of acoustic transducers 2. Each of the ASIC chips 3 may convert acoustic signals converted from each of the acoustic transducers 2 into required electrical signals.

As a preferred embodiment of the present invention, each of the plurality of ASIC chips 3 is electrically connected to the PCB substrate 5. Each of the ASCI chips 3 is electrically connected to other electronic devices (e.g., a signal processor) on the PCB substrate 5, so that the sound signals or the electrical signals may be then processed in a continuous and complete way.

It should be noted that each of the acoustic transducers 2 corresponds to an ASIC chip 3, and a signal output each of the ASIC chips is connected to a total output. Assuming that the sensitivity of the plurality of acoustic transducers 2 is S1, S2, S3 . . . Sn, respectively, then the total sensitivity S is calculated by the following formula:

$$S=(S1+S2+S3+\ldots+Sn)/n.$$

Wherein, Sn represents the sensitivity of the $n^{th}$ acoustic transducer, and n is a positive integer.

Therefore, the sensitivity remains the same, and a high sensitivity of the microphone is guaranteed.

The above descriptions are only the preferred embodiments of the invention, not thus limiting the embodiments and scope of the invention. Those skilled in the art should be able to realize that the schemes obtained from the content of specification and drawings of the invention are within the scope of the invention.

What is claimed is:

1. A microphone encapsulation structure having a plurality of transducers, comprising:

a housing;

a circuit base plate, wherein the circuit base plate and the housing form an acoustic cavity, and a first acoustic through-hole is provided on the circuit base plate;

a PCB (Printed Circuit Board) substrate disposed at a top of the circuit base plate, wherein the PCB substrate is provided with a plurality of second acoustic through-holes and the PCB substrate is provided with:

a plurality of acoustic transducers each disposed directly above one of the plurality of second acoustic through-holes; and a plurality of ASIC (Application Specific Integrated Circuit) chips each connected to one of the plurality of acoustic transducers via gold wire;

wherein the number of the acoustic transducer is four, the four acoustic transducers are arranged on the PCB substrate in two rows and in two columns, and a sound inlet hole of each of the four acoustic transducers corresponds to each of the plurality of second acoustic through-holes.

2. The microphone encapsulation structure having a plurality of transducers of claim 1, wherein a bottom surface of the circuit base plate is provided with a plurality of bonding pads electrically connected to the PCB substrate.

3. The microphone encapsulation structure having a plurality of transducers of claim 1, wherein the first acoustic through-hole is arranged at a center of the circuit base plate.

4. The microphone encapsulation structure having a plurality of transducers of claim 1, wherein an opening of the first acoustic through-hole surrounds an area directly below all of the second acoustic through-holes.

5. The microphone encapsulation structure having a plurality of transducers of claim 1, wherein the PCB substrate is a double-layer PCB, a support partition is interposed between the PCB substrate and the circuit base plate, and a rectangular hollow hole is formed in a middle of the support partition.

6. The microphone encapsulation structure having a plurality of transducers of claim 5, wherein an opening of the hollow hole surrounds an area directly below all of the second acoustic through-holes.

7. The microphone encapsulation structure having a plurality of transducers of claim 5, wherein both the PCB substrate of the support partition and the side surfaces of the support partition are in contact with an inner side wall of the housing.

8. The microphone encapsulation structure having a plurality of transducers of claim 1, wherein each of the plurality of ASIC chips is located at a side surface of one of the plurality of acoustic transducers.

9. The microphone encapsulation structure having a plurality of transducers of claim 1, wherein each of the plurality of ASIC chips is electrically connected to the PCB substrate.

* * * * *